US006018967A

United States Patent [19]

Hedeen et al.

[11] Patent Number: 6,018,967

[45] Date of Patent: Feb. 1, 2000

[54] NOISE REDUCING CLIP DEVICE FOR A WASHING MACHINE

[75] Inventors: Robert Arvin Hedeen, Clifton Park; Ziqiang Hu, Niskayuna; Walter John Smith, Ballston Spa, all of N.Y.

[73] Assignee: General Electric Company, Schenectady, N.Y.

[21] Appl. No.: 09/157,675

[22] Filed: Sep. 21, 1998

[51] Int. Cl.[7] ..... D06F 37/24

[52] U.S. Cl. ..... 68/23.3; 248/638; 248/677

[58] Field of Search ..... 68/23.1, 23.3; 248/638, 677

[56] References Cited

U.S. PATENT DOCUMENTS 3,744,710 7/1973 McCartney ..... 68/23.3 X 5,622,350 4/1997 Vande Haar ..... 248/677

*Primary Examiner*—Philip R. Coe

*Attorney, Agent, or Firm*—Marvin Snyder; Douglas E. Stoner

[57] ABSTRACT

A noise reducing clip device includes a clip body and a fulcrum-defining element. The clip body receives a washing machine wash tub wall and a fastener to secure the tub wall to the clip body and attach the clip body and tub wall therewith to a support leg disposed adjacent to the tub wall. The fulcrum-defining element is formed on and protrudes outwardly from the clip body for spacing the clip body from the support leg and providing only contact of the support leg with the fulcrum-defining element about which contact the support leg may undergo twisting and rocking motion induced by operation of a washing machine motor without imparting such motion to the tub wall via the clip body.

24 Claims, 2 Drawing Sheets

NOISE REDUCING CLIP DEVICE FOR A WASHING MACHINE

BACKGROUND OF THE INVENTION

The present invention generally relates to washing machines and, more particularly, is concerned with a noise reducing clip device for a washing machine.

A washing machine typically includes a bottom platform, an outside tub stationarily mounted upon the platform by a plurality of support legs, an inside tub for receiving items, clothes and the like, to be washed and being rotatably mounted within the outside tub, and a motor mounted beneath the platform and drivingly coupled to the inside tub for rotating the same in carrying out its wash, rinse and spin cycles. Each support leg is spaced circumferentially about the outside tub and mounted at a lower end on the bottom platform and rigidly attached at an upper end to a bottom circumferential flange of the outside tub.

A problem exists, however, with this basic arrangement of the washing machine. A twisting or rocking motion is produced by torque variation in the motor at a rate of twice line frequency, usually 120 Hz. This motion is transmitted through the bottom platform and support legs to the outside tub and may cause an annoying and undesirable booming noise during operation of the washing machine. This booming noise so produced may lead to a perception of poor quality. Because of the rigid connection of the support legs with the tub flange, the twisting motion over time may also result in cracking of the tub sidewall.

One solution to this problem previously attempted has been to employ compliant isolator springs or pads between the support legs and outside tub. The compliant isolator springs or pads, however, allow excessive vertical and transverse displacement of the support legs in relation to the outside tub which hinders reliable operation of the washing machine. One other proposed solution, the tuning of the bottom platform, is difficult because several twisting modes exist near the excitation frequency. Tuning one twisting mode out will typically bring another into play.

Consequently, a need still exists for a device which provides a solution to the aforementioned problem without introducing any new problems in place thereof.

BRIEF SUMMARY OF THE INVENTION

The present invention provides a noise reducing clip device designed to satisfy the aforementioned need. The noise reducing clip device improves the mounting of the outside tub to each support leg in the washing machine by providing a fulcrum between the support leg and outside tub about which any twisting or rocking motion of the support leg may occur without being imparted to the outside tub. The noise reducing clip device thereby eliminates or greatly reduces any booming noise which may otherwise be associated with the twisting and rocking motion.

In an exemplary embodiment of the present invention, a noise reducing clip device is provided which comprises a clip body and a fulcrum-defining element on the clip body. The clip body has a pair of spaced outer and inner wall portions forming a slot therebetween for receiving an edge portion of a wall of a tub of a washing machine. The clip body also has a pair of holes formed through the outer and inner wall portions and aligned with one another for receiving a fastener therethrough for securing the tub wall within the slot of the clip body and attaching the clip body and the edge portion of the tub wall therewith to a washing machine support leg disposed adjacent to the outer wall portion of the clip body and the tub wall of the washing machine. The fulcrum-defining element is formed on and protrudes outwardly from the outer wall portion of the clip body adjacent to the hole therein for spacing the outer wall portion of the clip body from the support leg and providing only contact of the support leg with the fulcrum-defining element about which contact the support leg may undergo twisting and rocking motion induced by operation of a motor of the washing machine without imparting such motion to the wall of the tub via the clip body.

In another exemplary embodiment of the present invention, a washing machine is provided which comprises a bottom platform, a tub assembly including an outside tub having a wall and an inside tub being rotatably mounted within the outside tub for receiving items to be washed, a plurality of support legs mounted upright on the bottom platform and spaced circumferentially about a wall of the outside tub and disposed adjacent to the wall of the outside tub, a motor mounted adjacent to the platform and drivingly coupled to the inside tub for rotating the inside tub in carrying out operations thereof, and a plurality of noise reducing clip devices. Each noise reducing clip device includes means for securing the support legs to the wall of the outside tub and means for defining a fulcrum between the wall of the outside tub and one of the support legs. The fulcrum-defining means spaces the wall of the outside tub away from the respective one support leg and provides only contact of the one support leg with the fulcrum-defining means about which contact the support leg may undergo twisting and rocking motion, induced by operation of the motor via the bottom platform, without imparting the motion to the wall of the outside tub.

BRIEF DESCRIPTION OF THE DRAWINGS

In the following detailed description, reference will be made to the attached drawings in which.

DETAILED DESCRIPTION OF THE INVENTION

Figure 1:
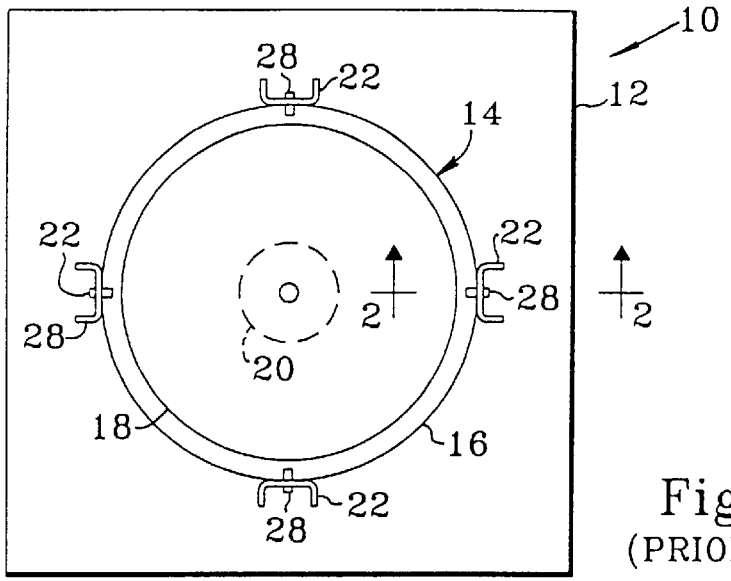
Fig. 1 (PRIOR ART)
FIG. 1 is a diagrammatic top plan view of a prior art washing machine.

Referring now to the drawings and particularly to FIG. 1, there is illustrated a prior art washing machine, generally designated 10. The washing machine 10 includes a bottom platform 12, a tub assembly 14 comprised of an outside tub 16 and an inside tub 18, a motor 20, and a plurality of support legs 22. The outside tub 16 is stationarily mounted upon the bottom platform 12 by the support legs 22 circumferentially spaced about the outside tub 16. The inside tub 18 receives items, such as clothes and the like, to be washed and is rotatably mounted and housed within the outside tub 16. The motor 20 is mounted beneath the bottom platform 12 and is drivingly coupled to the inside tub 18 for rotating the same in carrying out its wash, rinse and spin cycles.

Figure 2:
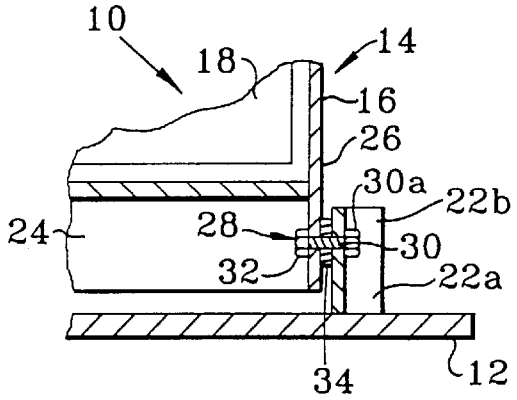
Fig. 2 (PRIOR ART)
FIG. 2 is a diagrammatic fragmentary side elevational view of the washing machine of FIG. 1 showing a washer and bolt mounting the bottom flange of the outside tub to one of the support legs.

Referring to FIG. 2, each support leg 22 is stationarily mounted at a lower end 22*a* upright upon the bottom platform 12 and rigidly attached at an upper end 22*b* to a circumferential bottom flange 24 on a side wall 26 of the outside tub 16. Each support leg 22 has a substantially U-shaped configuration in transverse cross-section. The washing machine 10 employs a plurality of fasteners 28, such as each being in the form of a bolt 30, nut 32 and washer 34, secure circumferentially spaced portions of the bottom flange 24 to upper ends 22*a* of the support legs 22. The washer 34 of each fastener 28 is disposed about the bolt 30 of the fastener 28 between the upper end 22*a* of the support leg 22 and the respective portion of the outside tub bottom flange 24. The washing machine 10 may have four or any other suitable number of the support legs 22, bolts 30 and washers 34. Multiple combinations of support legs 22, bolts 30 and washers 34 are spaced equidistantly apart from one another circumferentially about the outside tub 16 of the washing machine 10.

Figure 3:
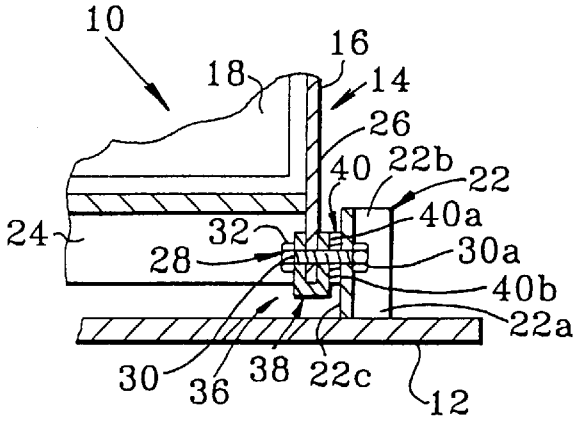
FIG. 3 is a diagrammatic fragmentary side elevational view of the washing machine of FIG. 2 but showing the noise reducing clip device of the present invention used in conjunction with the bolt to mount the bottom flange of the outside tub to one of the support legs.
Figure 4:
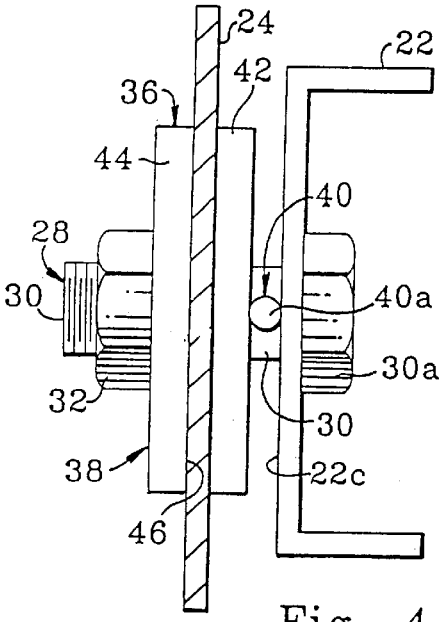
FIG. 4 is an enlarged top plan view of the noise reducing clip device as seen along line 4—4 of FIG. 3.
Figure 5:
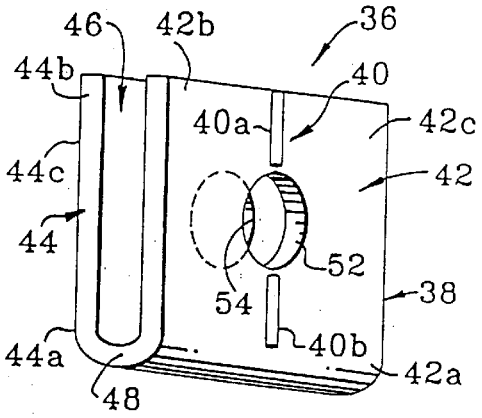
FIG. 5 is an enlarged front perspective view of the noise reducing clip device of FIG. 4 including a clip body and a fulcrum-defining element thereon having a first configuration.

Referring to FIGS. 3 to 5, there is illustrated a noise reducing clip device, generally designated 36, of the present invention, a plurality of which are substituted in the washing machine 10 of the prior art in place of the washers 34. The noise reducing clip device 36 basically includes a clip body 38 and a fulcrum-defining element 40 on the clip body 38.

The clip body 38 of the noise reducing clip device 36 has a substantially U-shaped configuration formed by pair of spaced apart outer and inner wall portions 42, 44 defining an elongated slot 46 therebetween and a bight portion 48 which interconnects the outer and inner wall portions 42, 44 at their lower ends 42*a*, 44*a*. Each of the outer and inner wall portions 42, 44 is generally flat and has a substantially rectangular configuration in transverse cross-section. The outer and inner wall portions 42, 44 are of the same size and disposed in substantially parallel relation to one another. The upper ends 42*b*, 44*b* of the outer and inner wall portions 42, 44 are spaced apart so as to define an entry opening 50 to the slot 46 for receiving therethrough the portion of the bottom flange 24 of the side wall 26 of outside tub 16. The clip body 38 also has a pair of holes 52, 54 formed through the respective outer and inner wall portions 42, 44 and being aligned with one another. One of the fasteners 28 is disposed through the holes 52, 54 of the outer and inner wall portions 42, 44 of the clip body 38 and secures the side wall 26 of the outside tub 16 within the slot 46 of the clip body 38 and attaches the clip body 38 and edge portion of the bottom flange 24 of the outside tub 16 therewith to the respective one support leg 22. A head end 30*a* of the bolt 30 of the fastener 28 engages the support leg 22 and the nut 32 threaded on the opposite stem end of the bolt 30 engages an outer surface 44*c* of the inner wall portion 44 of the clip body 38. The clip body 38 can be made from any suitable rigid material, such as a metal or plastic.

The fulcrum-defining element 40 of the noise reducing clip device 36 is formed on an outer surface 42*c* of the outer wall portion 42 of the clip body 38 adjacent to the hole 52 and protrudes outwardly therefrom for spacing the outer wall portion 42 from the respective one support leg 22 and only contact of the support member 22 with the fulcrum-defining element 40 about which contact the support leg 22 may undergo twisting and rocking motion induced by operation of the motor 20 of the washing machine 10 without imparting such motion to the side wall 26 of the outside tub 16 via the clip body 38. The washing machine 10 may employ four or any other suitable number of the noise reducing clip devices 36. Multiple combinations of support legs 22, fasteners 28 and clip devices 36 are spaced an equal distance apart from one another circumferentially about the outside tub 16 of the washing machine 10. The clip body 38 serves to hold and correctly position the fulcrum-defining element 40 and also to distribute the clamping load over a wider area of the tub side wall 26.

The fulcrum-defining element 40 is preferably formed in two parts 40*a*, 40*b* respectively disposed above and below the hole 52 in the outer wall portion 42. The two parts 40*a*, 40*b* are arranged vertically on the outer surface 42*a* and aligned with one another such that the fulcrum-defining element 40 makes substantially a line of contact with the facing surface 22*c* of the one support leg 22. The fulcrum-defining element 40 need not protrude outwardly very far from the outer surface 42*c* of the outer wall portion 42 of the clip body 38 because the magnitude of the vertical twisting motion of the support leg 22 is quite small at the problem frequency. It has been found that it is sufficient for the element 40 to protrude outwardly for a distance of about 0.25 cm from the outer surface 42*c* of the outer wall portion 42 of the clip body 38. The fulcrum-defining element 40 may be comprised of any suitable rigid material and attached to the outer surface 42*c* in any suitable manner.

Figure 6:
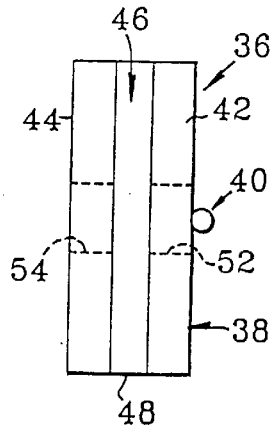
FIG. 6 is a top plan view of the device of FIG. 5 having the first configuration of the fulcrum-defining element.
Figure 7:
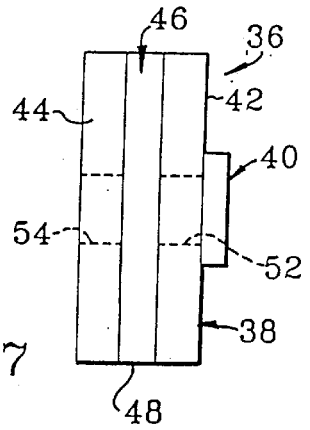
FIG. 7 is a top plan view of the device having a second configuration of the fulcrum-defining element.
Figure 8:
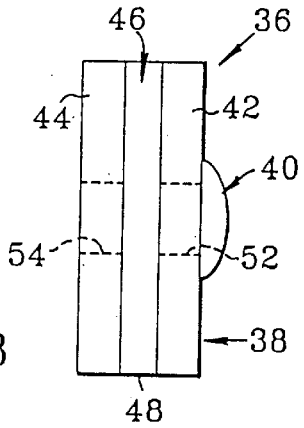
FIG. 8 is a top plan view of the device having a third configuration of the fulcrum-defining element.
Figure 9:
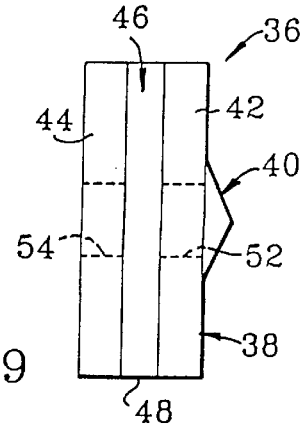
FIG. 9 is a top plan view of the device having a fourth configuration of the fulcrum-defining element.

Referring to FIGS. 4 to 9, four different exemplary cross-sectional configurations of the fulcrum-defining element 40 are disclosed. As seen in FIGS. 4 to 6, in a first configuration the fulcrum-defining element 40 has a wire-like cylindrical form and a circular cross-sectional shape. In FIG. 7 the fulcrum-defining element 40 has a button-like or boss-like form and a rectangular cross-sectional shape. In FIG. 8 the fulcrum-defining element 40 has a chord-like form and a convex curved cross-sectional shape. In FIG. 9 the fulcrum-defining element 40 has a substantially V cross-sectional shape diverging toward the outer surface 42*c*. Alternatively, if desired these various configurations can be formed so as to make substantially a point of contact with the support leg 22, instead of a line of contact, about which contact the twisting motion of the support leg 22 can take place.

Several of the above-noted configurations of the fulcrum-defining element 40 on the clip devices 36 have been tested for effectiveness on production washing machines. It has been found that the clip devices 36 reduce overall noise levels by 2 to 4 dBA, depending on the particular wash cycle and the presence of other extraneous noises unrelated to the platform displacement. The clip devices 36 are most effective in reducing noise in the spin cycle. The clip devices 36 can be provided in new production washing machines and as replacement parts retrofittable in existing machines.

In summary, the employment of the clip devices 36 provide an effective way to decouple the twisting or rocking motion of the support legs 22 from the tub assembly 14 while still providing a still and stable attachment between the platform support legs 22 and the tub assembly 14 in the vertical and transverse directions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A noise reducing clip device, comprising:

a clip body having a pair of spaced outer and inner wall portions forming a slot therebetween for receiving an edge portion of a wall of a tub of a washing machine and a pair of holes formed through said outer and inner wall portions and aligned with one another for receiving a fastener therethrough for securing the tub wall within said slot of said clip body and attaching said clip body and edge portion of the tub wall therewith to a washing machine support leg disposed adjacent to said outer wall portion of said clip body and the tub wall of the washing machine; and a fulcrum-defining element formed on and protruding outwardly from said outer wall of said clip body adjacent to said hole therein for spacing said outer wall portion of said clip body from the support leg and providing only contact of the support leg with said fulcrum-defining element about which contact the support leg may undergo twisting and rocking motion induced by operation of a motor of the washing machine without imparting such motion to the wall of the tub via said clip body.

2. The device of claim 1 in which each of said outer and inner wall portions of said clip body is generally flat.

3. The device of claim 1 in which said outer and inner wall portions of said clip body are disposed in substantially parallel relation to one another.

4. The device of claim 1 in which each of said outer and inner wall portions of said clip body has opposite upper and lower ends, said clip body also having a bight portion which interconnects said outer and inner wall portions to one another at said lower ends thereof.

5. The device of claim 4 in which said outer and inner wall portions are spaced apart at said upper ends thereof so as to define an entry opening to said slot formed between said outer and inner wall portions of said clip body.

6. The device of claim 1 in which said clip body has a substantially U-shaped configuration.

7. The device of claim 1 in which said fulcrum-defining element is disposed adjacent to and on opposite sides of said hole of said outer wall portion of said clip body.

8. The device of claim 1 in which said fulcrum-defining element is arranged vertically on said outer wall portion of said clip body.

9. The device of claim 1 in which said fulcrum-defining element on said outer wall portion has a substantially cylindrical configuration.

10. The device of claim 1 in which said fulcrum-defining element on said outer wall portion has a substantially convex curved configuration.

11. The device of claim 1 in which said fulcrum-defining element on said outer wall portion has a substantially V-shaped configuration diverging toward said outer wall portion of said clip body.

12. The device of claim 1 in which said fulcrum-defining element provides a line of contact between the support leg and said fulcrum-defining element.

13. The device of claim 1 in which said fulcrum-defining element provides a point of contact between the support leg and said fulcrum-defining element.

14. A washing machine, comprising:

a bottom platform;

a tub assembly including an outside tub having a wall and an inside tub being rotatably mounted within said outside tub for receiving items to be washed;

a plurality of support legs mounted upright on said bottom platform and spaced circumferentially about a wall of said outside tub and disposed adjacent to said wall of said outside tub;

a motor mounted adjacent to said platform and drivingly coupled to said inside tub for rotating said inside tub in carrying out operations thereof; and a plurality of noise reducing clip devices, each of said devices including means for securing a respective one of said support legs to said wall of said outside tub, and means for defining a fulcrum between said wall of said outside tub and said respective one support leg, said fulcrum-defining means spacing said wall of said outside tub away from said respective one support leg and providing only contact of said respective one support leg with said fulcrum-defining means about which contact said respective one support leg may undergo twisting and rocking motion, induced by operation of said motor via said bottom platform, without imparting said motion to said wall of said outside tub.

15. The machine of claim 14 in which said securing means of each of said devices includes:

a clip body disposed adjacent to said respective one support leg and having a pair of spaced outer and inner wall portions forming a slot therebetween for receiving an edge portion of said wall of said outside tub and a pair of holes formed through said outer and inner wall portions and aligned with one another; and a fastener received through said holes so as to secure said wall of said outside tub within said slot of said clip body and attach said clip body and edge portion of said wall of said outside tub therewith to said respective one support leg.

16. The machine of claim 15 in which each of said outer and inner wall portions of said clip body has opposite upper and lower ends, said clip body also having a bight portion which interconnects said outer and inner wall portions to one another at said lower ends thereof, said outer and innerwall portions being spaced apart at said upper ends thereof so as to define an entry opening for insertion of said edge portion of said wall of said outside tub into said slot formed between said outer and inner wall portions of said clip body.

17. The machine of claim 15 in which said clip body has a substantially U-shaped configuration.

18. The machine of claim 15 in which said fulcrum-defining means is formed on and protrudes outwardly from said outer wall portion of said clip body adjacent to said hole therein so as to space said outer wall portion of said clip body from said respective one support leg and provide only said contact of said respective one support leg with said fulcrum-defining means.

19. The machine of claim 18 in which said fulcrum-defining means is disposed adjacent to and on opposite sides of said hole of said outer wall portion of said clip body.

20. The machine of claim 18 in which said fulcrum-defining means on said outer wall portion has a substantially cylindrical configuration.

21. The machine of claim 18 in which said fulcrum-defining means on said outer wall portion has a substantially convex curved configuration.

22. The machine of claim 18 in which said fulcrum-defining means on said outer wall portion has a substantially V-shaped configuration diverging toward said outer wall portion of said clip body.

23. The machine of claim 18 in which said fulcrum-defining means provides a line of contact between said respective one support leg and said fulcrum-defining means.

24. The machine of claim 18 in which said fulcrum-defining means provides a point of contact between said respective one support leg and said fulcrum-defining means.

* * * * *